US006923729B2

(12) United States Patent
McGinty et al.

(10) Patent No.: US 6,923,729 B2
(45) Date of Patent: Aug. 2, 2005

(54) GOLF CLUB WITH IMPACT DISPLAY

(76) Inventors: Joseph R. McGinty, 194 Brentwood La., Madison, AL (US) 35768; Charles C Patterson, 720 Desoto Rd., Huntsville, AL (US) 35831

( * ) Notice: Subject to any disclaimer, the term of this patent is extended or adjusted under 35 U.S.C. 154(b) by 191 days.

(21) Appl. No.: 10/212,394

(22) Filed: Aug. 5, 2002

(65) Prior Publication Data

US 2003/0032494 A1 Feb. 13, 2003

Related U.S. Application Data

(60) Provisional application No. 60/311,588, filed on Aug. 10, 2001.

(51) Int. Cl.[7] ..... A63B 57/00

(52) U.S. Cl. ..... 473/222; 473/131; 473/219; 473/220

(58) Field of Search ..... 473/219–225, 473/139–141, 324, 329

(56) References Cited

U.S. PATENT DOCUMENTS 4,940,236 A * 7/1990 Allen ..... 473/223
4,991,850 A * 2/1991 Wilhlem ..... 473/233
5,209,483 A * 5/1993 Gedney et al. ..... 473/223
6,196,932 B1 * 3/2001 Marsh et al. ..... 473/223
6,224,493 B1 * 5/2001 Lee et al. ..... 473/223
6,402,634 B2 * 6/2002 Lee et al. ..... 473/223
6,638,175 B2 * 10/2003 Lee et al. ..... 473/223
6,648,769 B2 * 11/2003 Lee et al. ..... 473/223

* cited by examiner

*Primary Examiner*—Jessica Harrison
*Assistant Examiner*—Alex F. R. P. Rada, II
(74) *Attorney, Agent, or Firm*—Gardner Groff, P.C.

(57) ABSTRACT

A golf training club comprising optical sensors, electronics and a display to provide visual feedback related to how a golfer strikes a golf ball. The club includes a shaft having a grip end and a tip distal from the grip end. The club has a club head affixed to the shaft proximate the tip that has a face for striking a golf ball. The optical sensors are embedded in the head and generate signals representative of the contact between the face and ball. The electronics, mounted within the shaft's grip end, process the sensor signals to determine the location of the contact between the face and ball. The display is operable to show such location. The electronics also process the sensor signals to determine whether the ball is tending to slice or hook by detecting lateral movement of the ball during contact with the face.

19 Claims, 23 Drawing Sheets

GOLF CLUB WITH IMPACT DISPLAY

CROSS-REFERENCE TO RELATED APPLICATION

This application claims the priority benefit of U.S. Provisional Patent Application No. 60/311,588, filed on Aug. 10, 2001, which is hereby incorporated by reference in its entirety.

TECHNICAL FIELD

The present invention relates generally to golf clubs and more particularly to a training golf club with impact sensors in the face of the club head and a display to show where on the club face the ball was struck.

BACKGROUND OF THE INVENTION

Golf is a simple game to understand and a very difficult game to master. Many people struggle with fundamentally unsound swings and would like to improve their golf swings and thereby increase their enjoyment of the game. Unfortunately, when most golfers try to improve their swings, they do so without adequate feedback (information) about what they are doing right and what they are doing wrong. For example, one of the most important aspects of the golf swing is to hit the ball reasonably close to the middle of the club face and to do so with the club face pointing at the target (perpendicular to the desired ball flight). The problem is that when a typical golfer mishits a shot, he or she often has no idea of what was wrong with the swing. The golfer usually doesn't know if the ball struck the correct part of the club face, if the club face was pointed at the target or not, or if the club head was moving along the correct swing path. Generally speaking, in order to improve, one needs to know what one is doing incorrectly so that an appropriate correction can be made to try to swing the club correctly in a repeatable manner.

Accordingly, it can be seen that a need yet remains in the art for a golf club device that provides good feedback to the golfer about the nature of the contact between the club and the golf ball at impact. It is to the provision of such a golf club that the present invention is primarily directed.

SUMMARY OF THE INVENTION

The invention is golf club including a sensor system that is mounted within or on the face of a conventional golf club to provide a signal used by electronics mounted within the golf club to provide a visual indication of where and how the ball impacted the head of the club when hit by the user. This allows the club to be used in practice at a driving range, golf course, or back yard and gives an immediate visual indication to the user of how and where the ball was hit by the club face.

Briefly described, in a first preferred form the present invention comprises a golf training club for use by a golfer. The golf training club includes a shaft having a grip and and tip distal from the grip end. The training club also includes a club head affixed to the shaft near the tip of the shaft. The club head has a face for striking a golf ball. A plurality of sensors are positioned adjacent the face of the club head for detecting contact between the face and a golf ball. Electronics are mounted within the head or within the shaft for processing signals from the sensors for analyzing at least the location of the contact between the face and a golf ball. A display is provided for displaying to the golfer at least the location of the contact between the face and the golf ball.

Preferably, the golf training club utilizes an array of optical sensors and the display is mounted adjacent the grip end of the shaft. Also preferably, the electronics are operative to further analyze the existence and extent of any side spin resulting from contact of the ball on the face. Also preferably, the electronics are housed within the club head and are operative for sensing, in conjunction with the sensor array, whether any of the individual sensors has been covered, thereby indicating a hit, to begin recording data. The data so recorded is used to a display an image representing more than one hit on the display. The image displayed representing more than one hit can be an image of an average hit taken over a previous collection of hits. Similarly, the display can be a composite image of numerous prior hits to show the pattern of contact location on the club face. Optionally, the electronics can be operative for calculating an estimated distance the ball would be estimated to travel based at least in part on measurements made at the club face at impact with the ball.

Preferably, the club head is a driver or other type of "metal wood" club head. However, the invention could be provided in the form of or in conjunction with an "iron" type club head.

The invention advantageously provides a learning tool to provide immediate feedback for golfers to allow them to improve the accuracy with which they hit the golf ball. The invention provides this immediate feedback showing the golfer where the ball was hit in relation to the proper position (i.e., the so-called sweet spot) on the club head. The invention also provides good feedback of the quality of the impact in relation to the proper angle by giving an indication of whether the ball would tend to slice or hook in response to contact with the club face. The invention provides useful information and it helps the user to avoid or break bad habits.

Providing immediate feedback as to where and how the ball impacted the head of the club when hit is very helpful. This is further enhanced by the invention allowing for practicing in locations other than the golf course. For example, when at a golf course or driving range and the golfer hits the ball, at least some feedback is provided by any club in the form of the observed flight of the ball. When practicing at home by hitting into a practice net with a conventional club, unfortunately even that little bit of feedback information is eliminated. The present invention allows the golfer to obtain very good feedback information even when practicing at home hitting into a net, thereby expanding the opportunities for effective practice.

BRIEF DESCRIPTION OF THE DRAWING FIGURES

Figure 2:
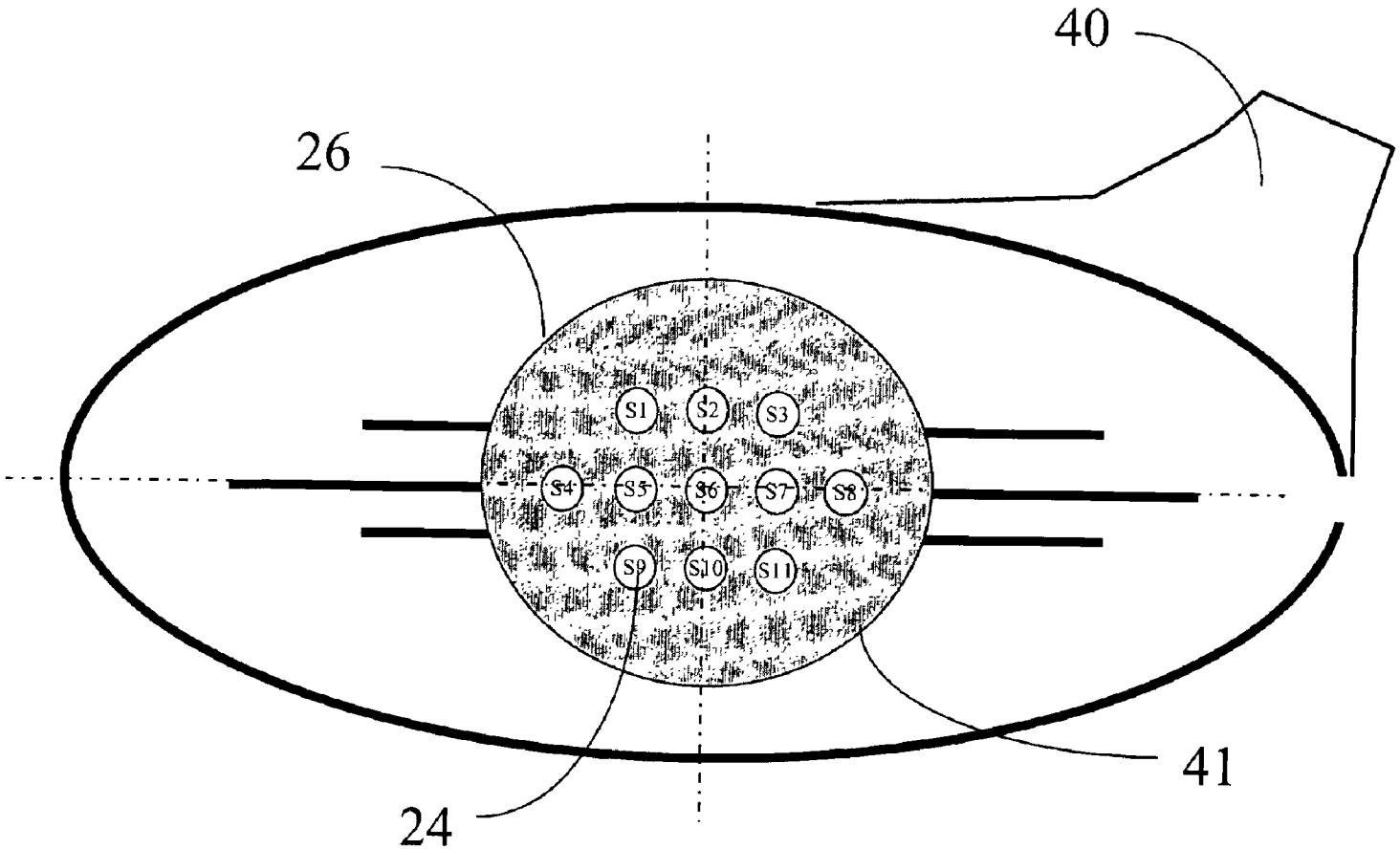
FIG. 2 is a schematic illustration of a club head portion of the golf club of FIG. 1.
Figure 4:
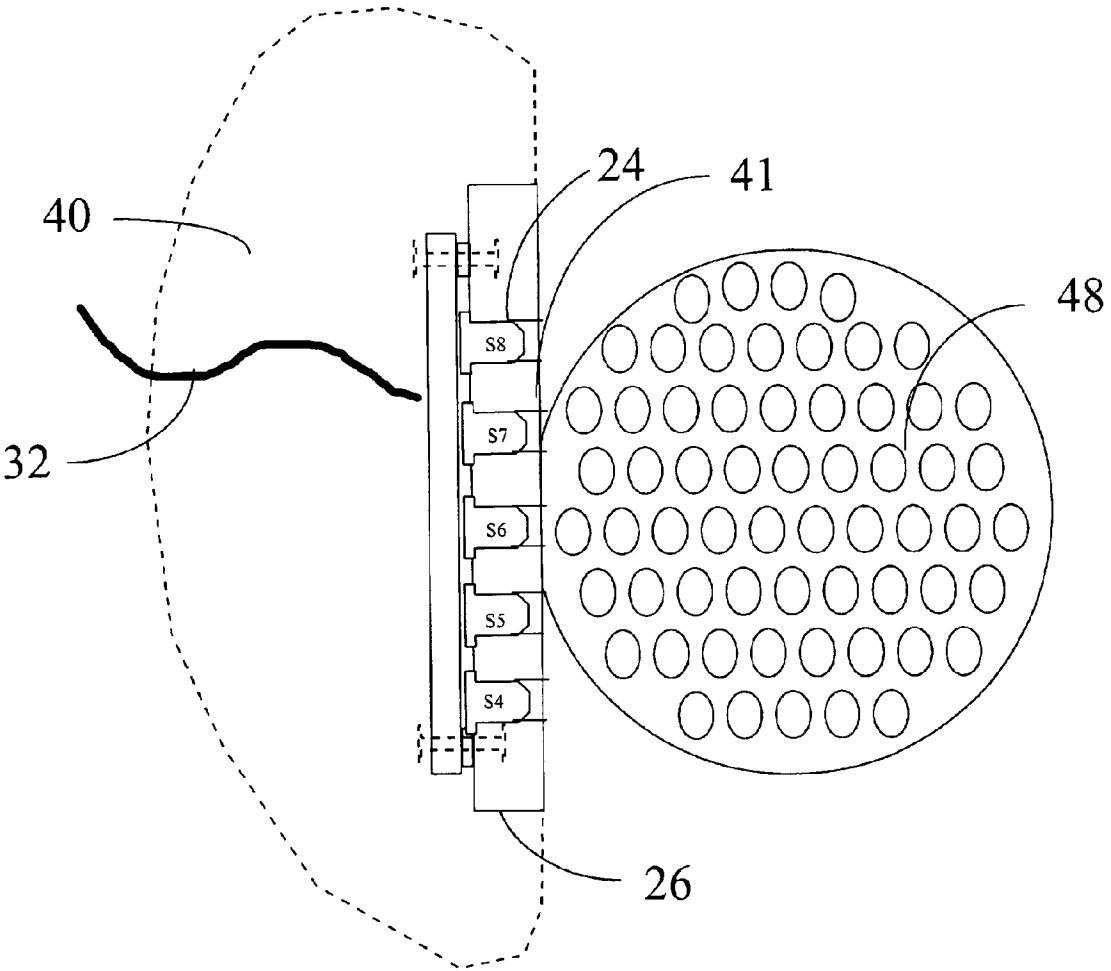
FIG. 4 is a schematic, sectional illustration of the club head portion of the golf club of FIG. 2, shown in contact with a golf ball.
Figure 4A:
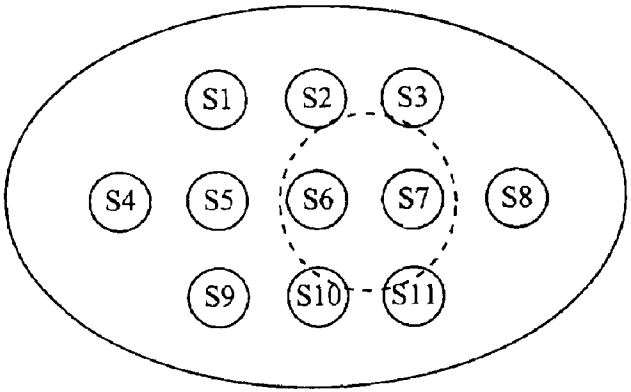

FIG. 4*a* is a schematic illustration of the face portion of the club head of FIG. 2, depicting an array of sensors and a ball impact location.

Figure 1:
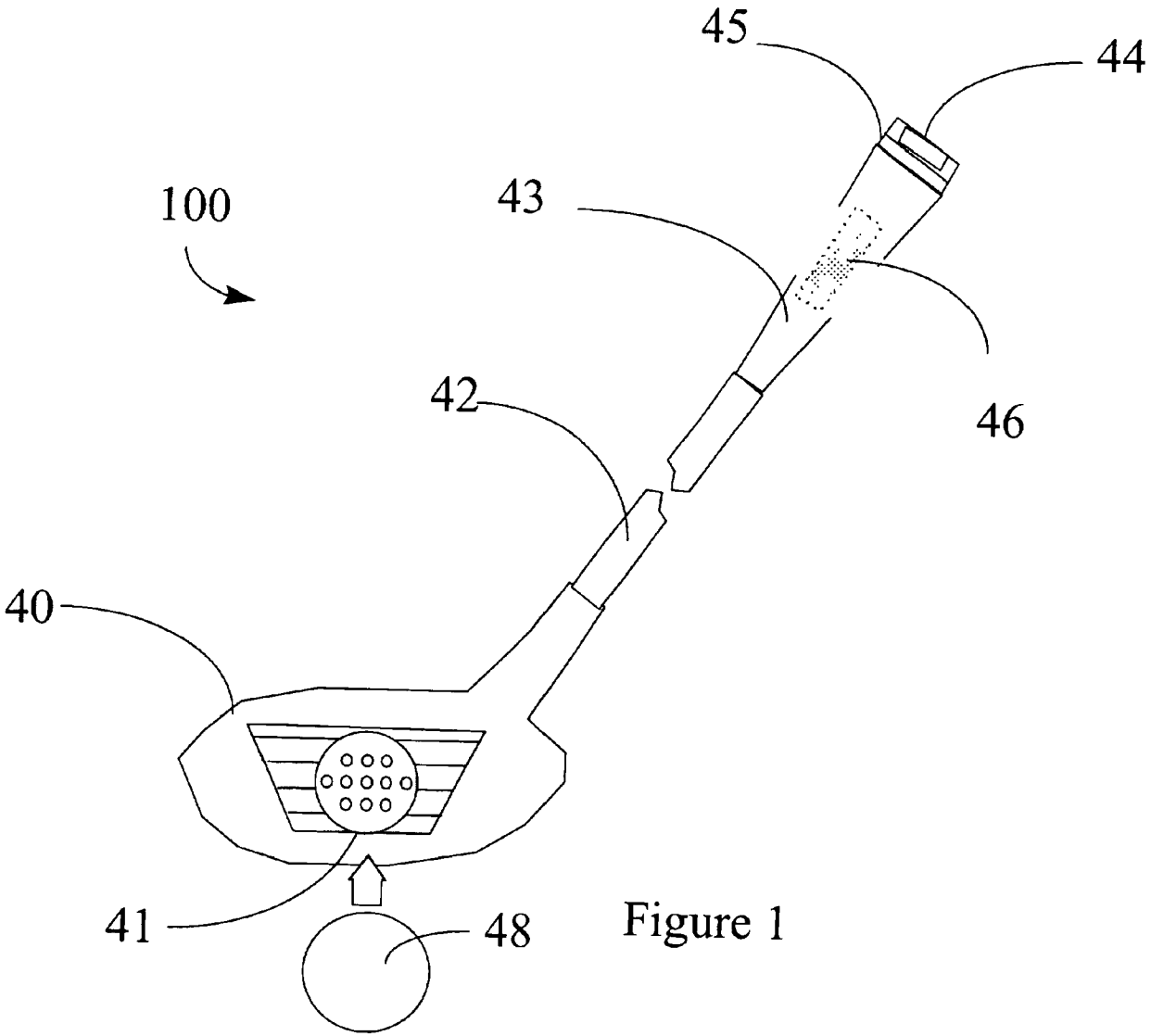
FIG. 1 is a schematic illustration of a golf club according to a preferred form of the invention.
Figure 4B:
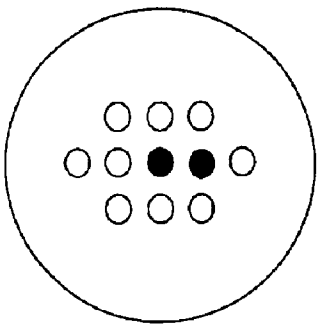

FIG. 4*b* is a schematic illustration of a display screen portion of the golf club of FIG. 1 and shown depicting ball contact at the location depicted in FIG. 4*a*.

Figure 5:
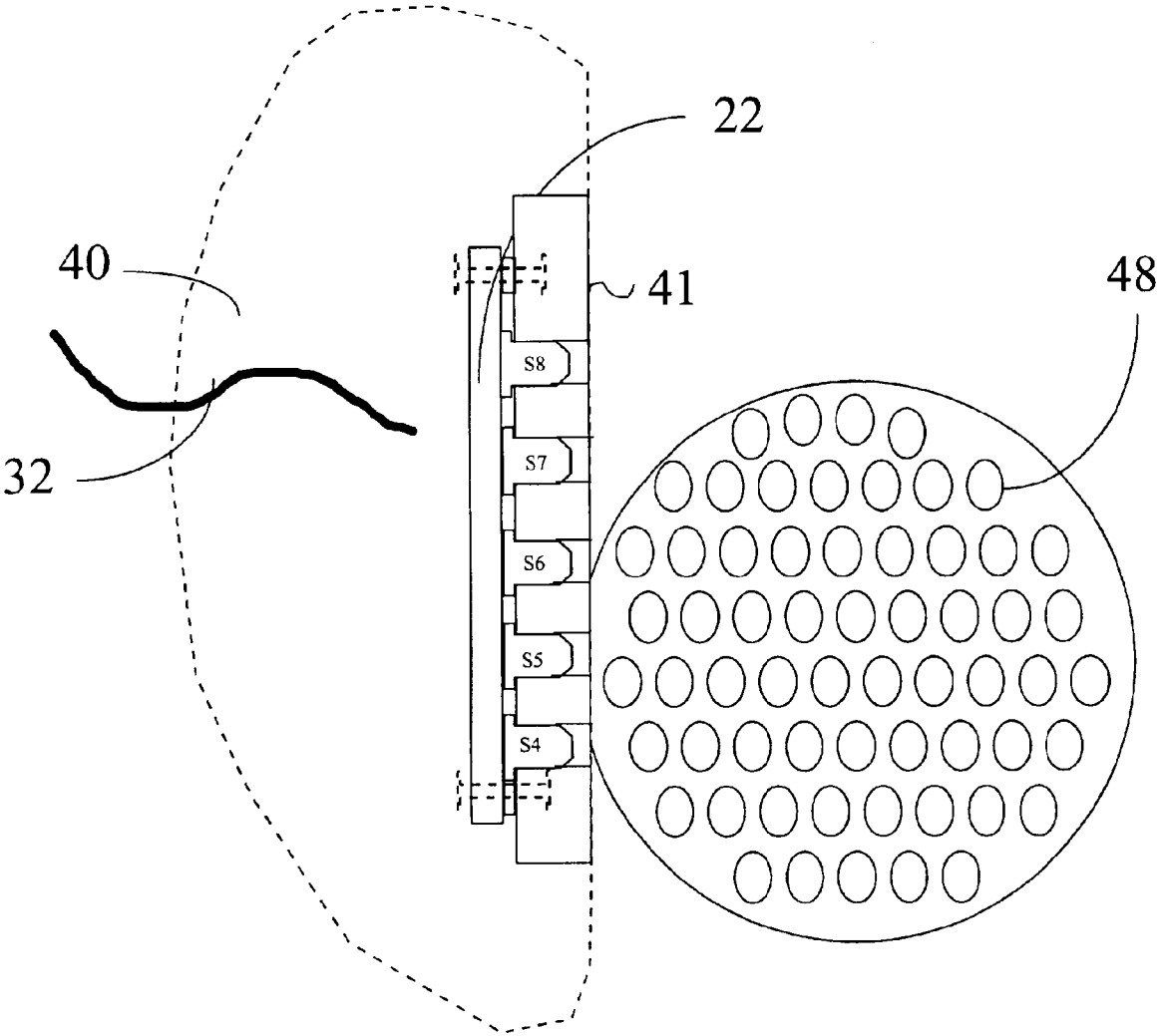

FIG. 5 is another schematic, sectional illustration of the club head portion of the golf club of FIG. 2, shown in off-center contact with a golf ball.

Figure 5A:
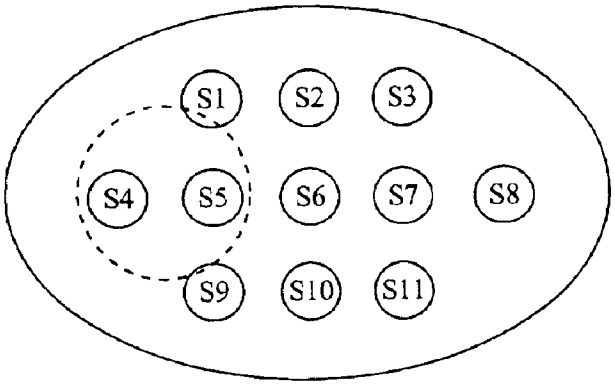

FIG. 5*a* is a schematic illustration of the face portion of the club head of FIG. 2, depicting an array of sensors and an off-center ball impact location as shown in FIG. 4.

Figure 5B:
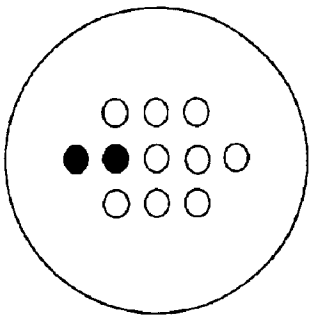

FIG. 5*b* is a schematic illustration of the display screen portion of the golf club of FIG. 1 and shown depicting the off-center ball contact at the location depicted in FIG. 5*a*.

Figure 6:
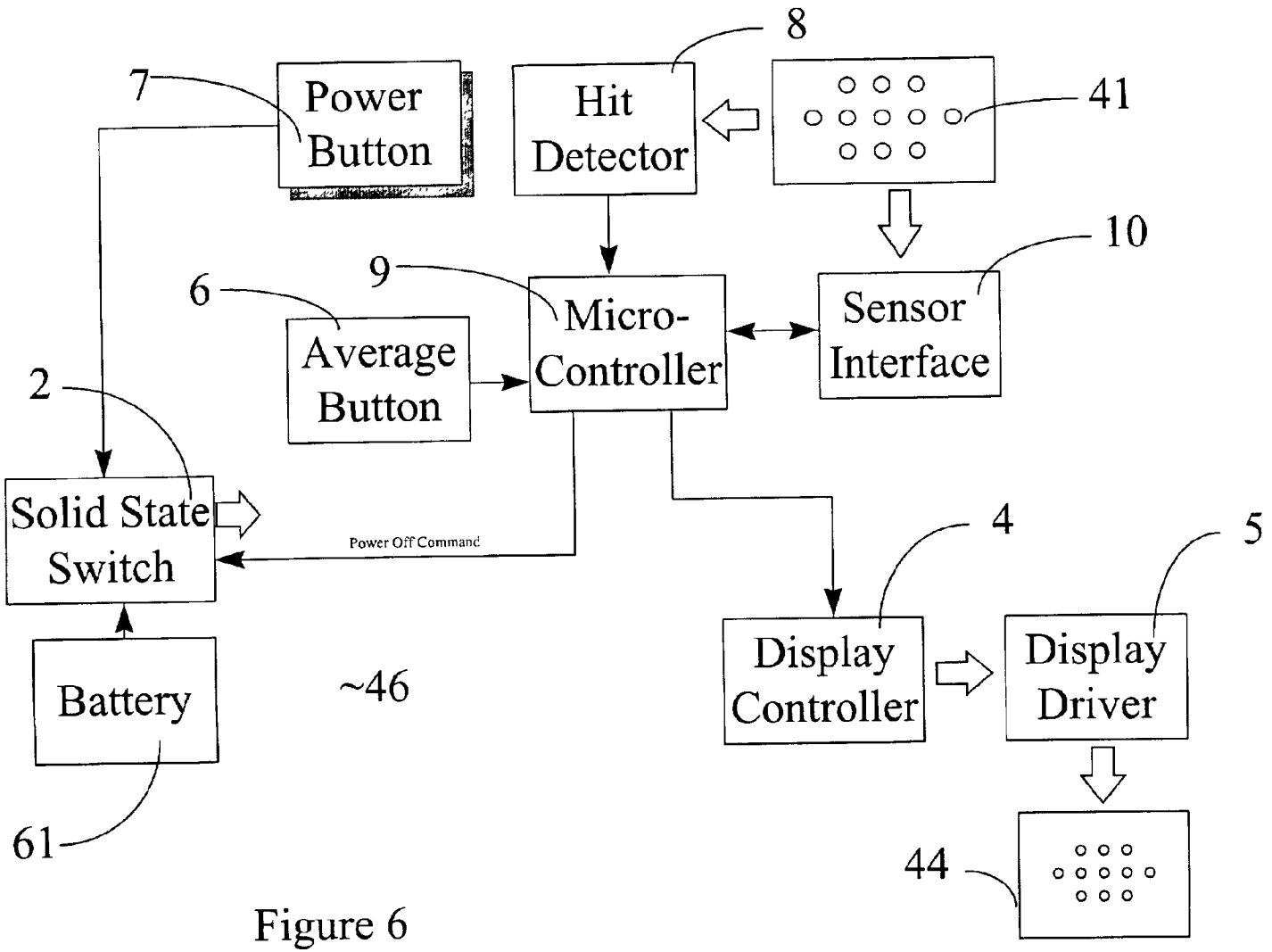

FIG. 6 is a schematic illustration of an electronics circuit portion of the golf club of FIG. 1.

Figure 7:
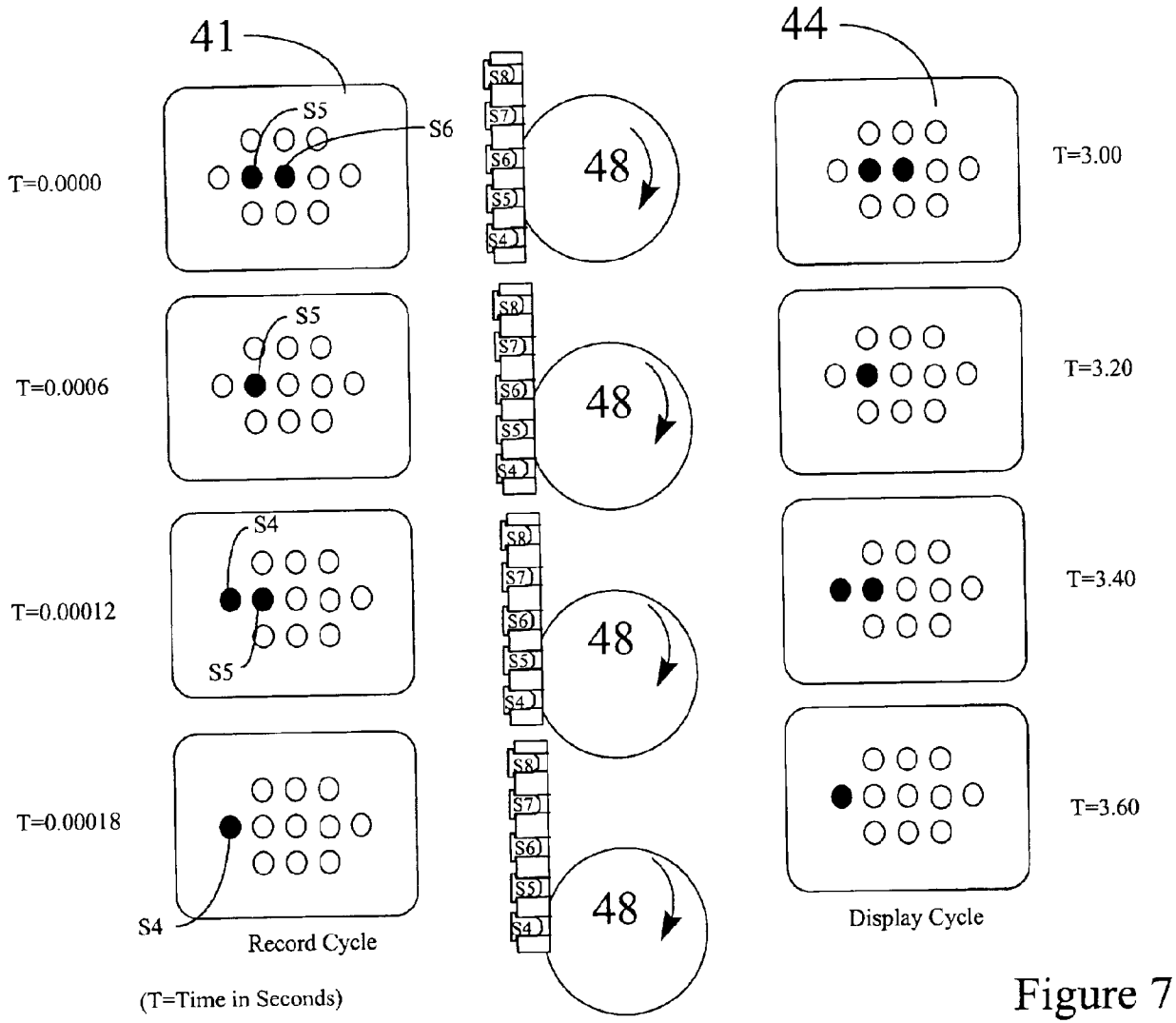

FIG. 7 is a schematic illustration depicting the sequential contact of a ball with the club face of FIG. 1 and showing the lateral movement of the ball across the club face while in contact therewith, as well as depicting the occlusion of various sensors over the same time and the corresponding display images.

Figure 8:
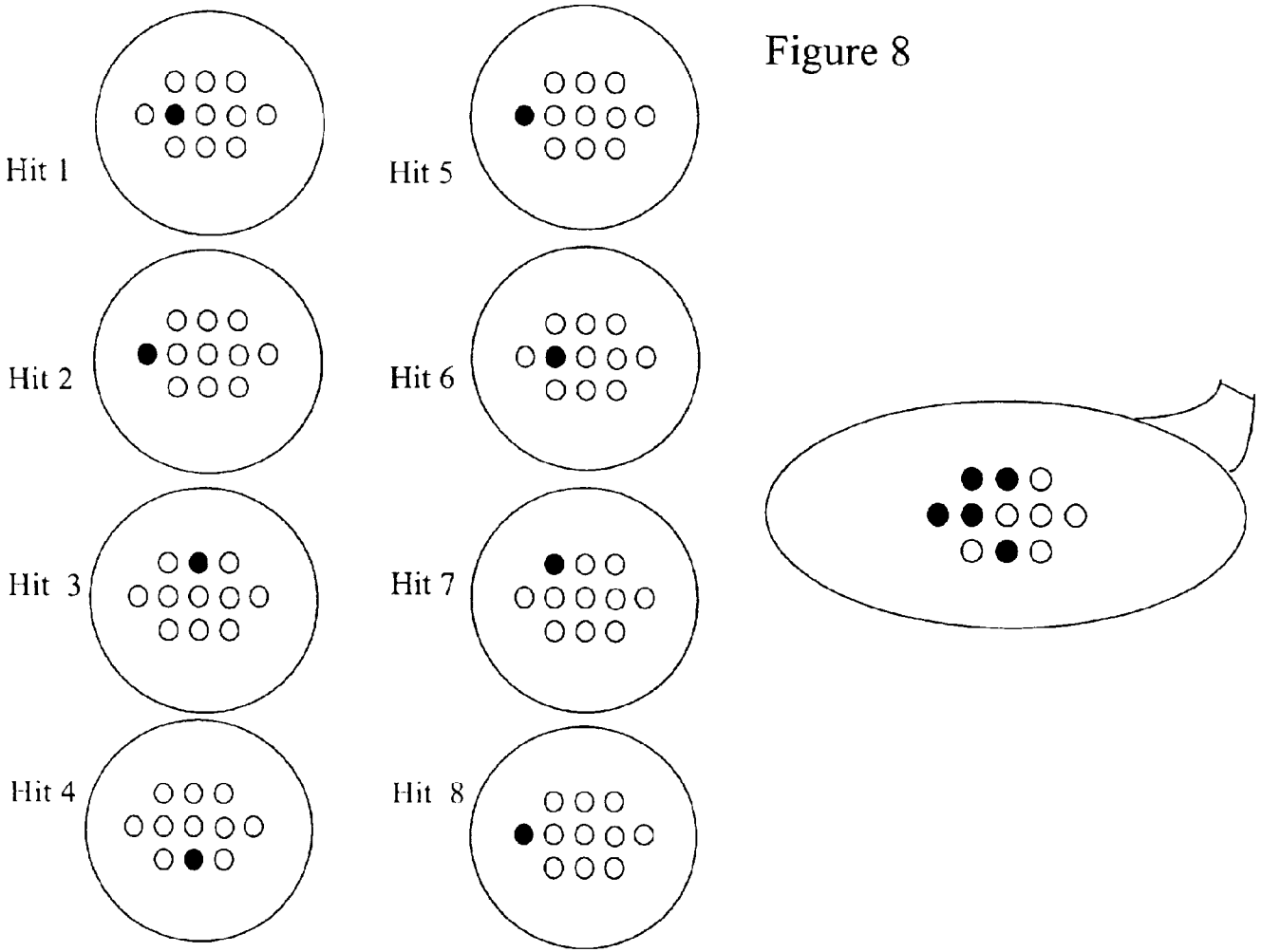

FIG. 8 is a schematic illustration of portions of the club of FIG. 1 in use.

Figure 9:
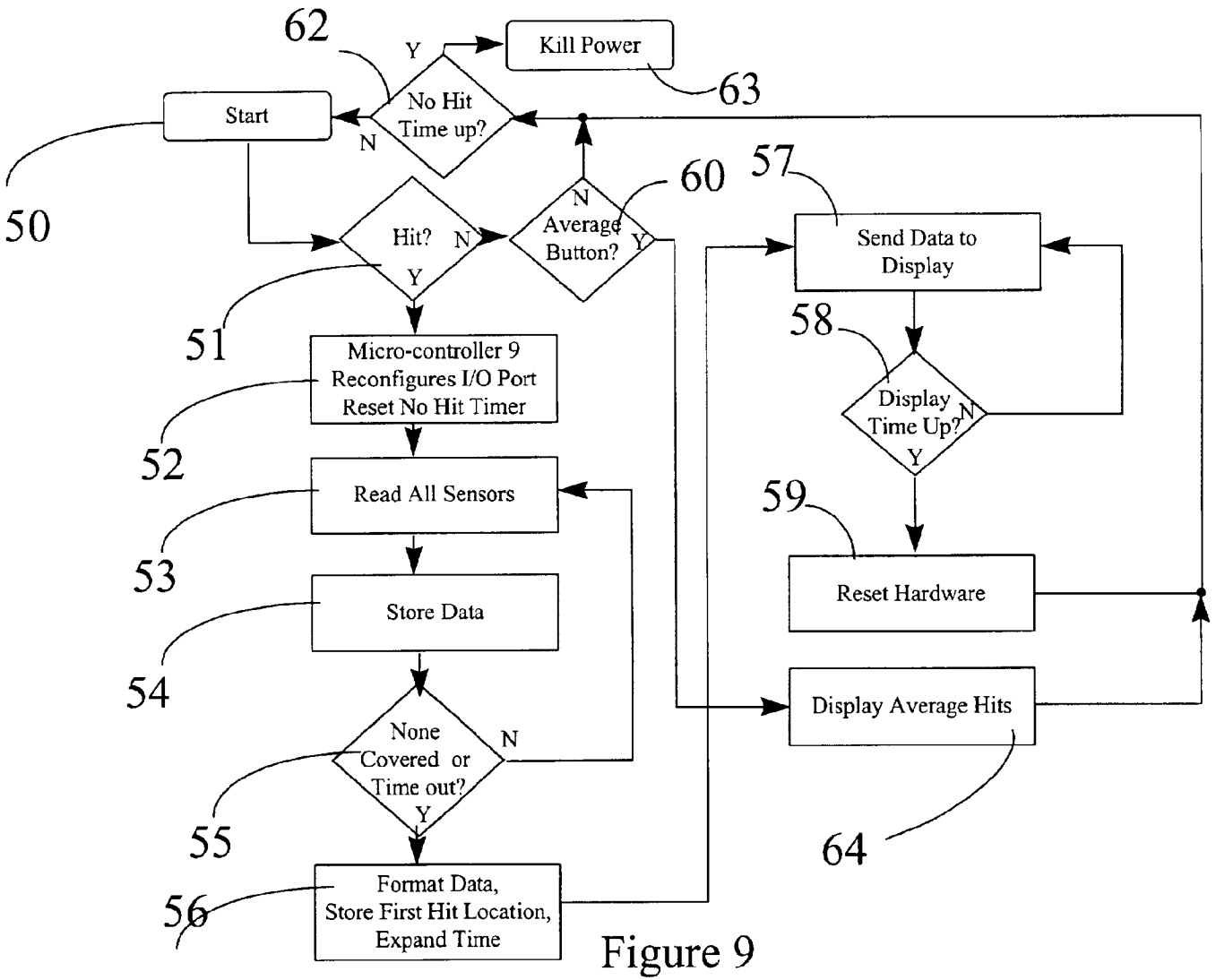

FIG. 9 is a flow chart depicting the operation of the electronics and the display of the golf club of FIG. 1.

Figure 10:
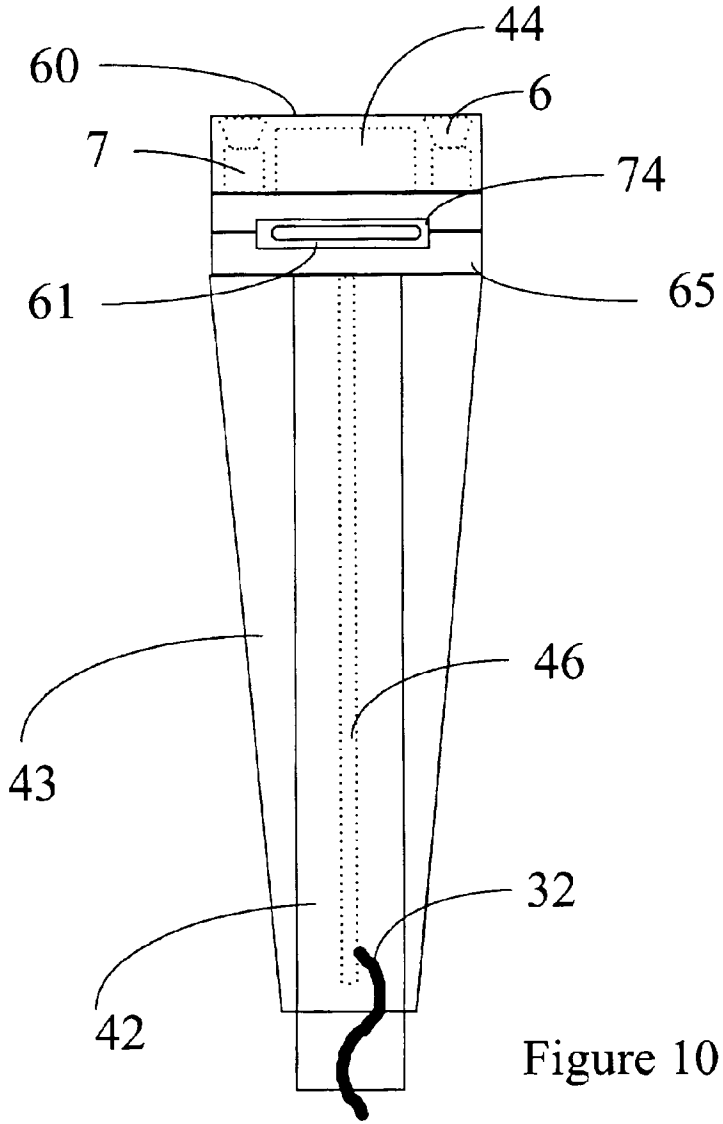
Figure 11A:
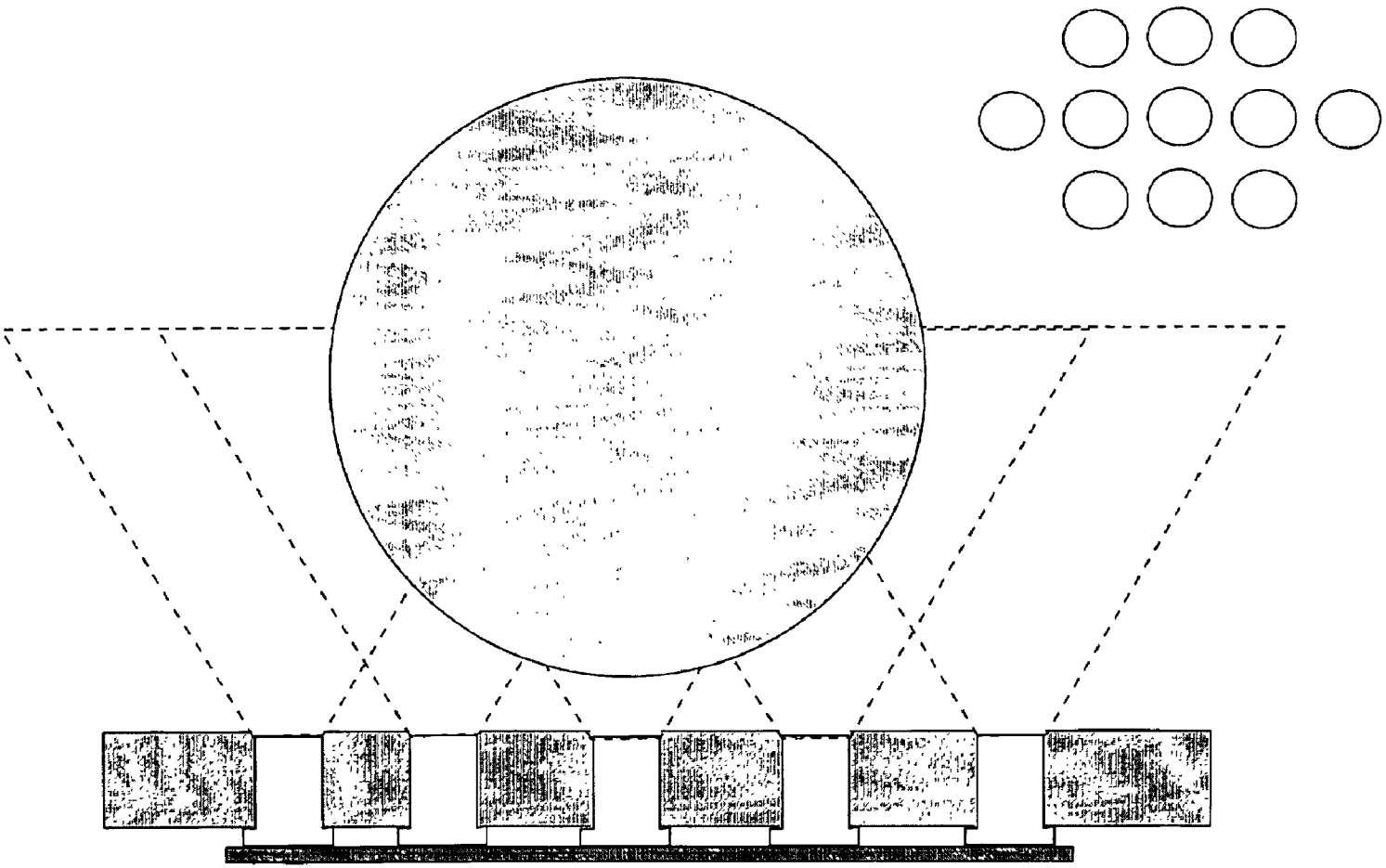
Figure 11B:
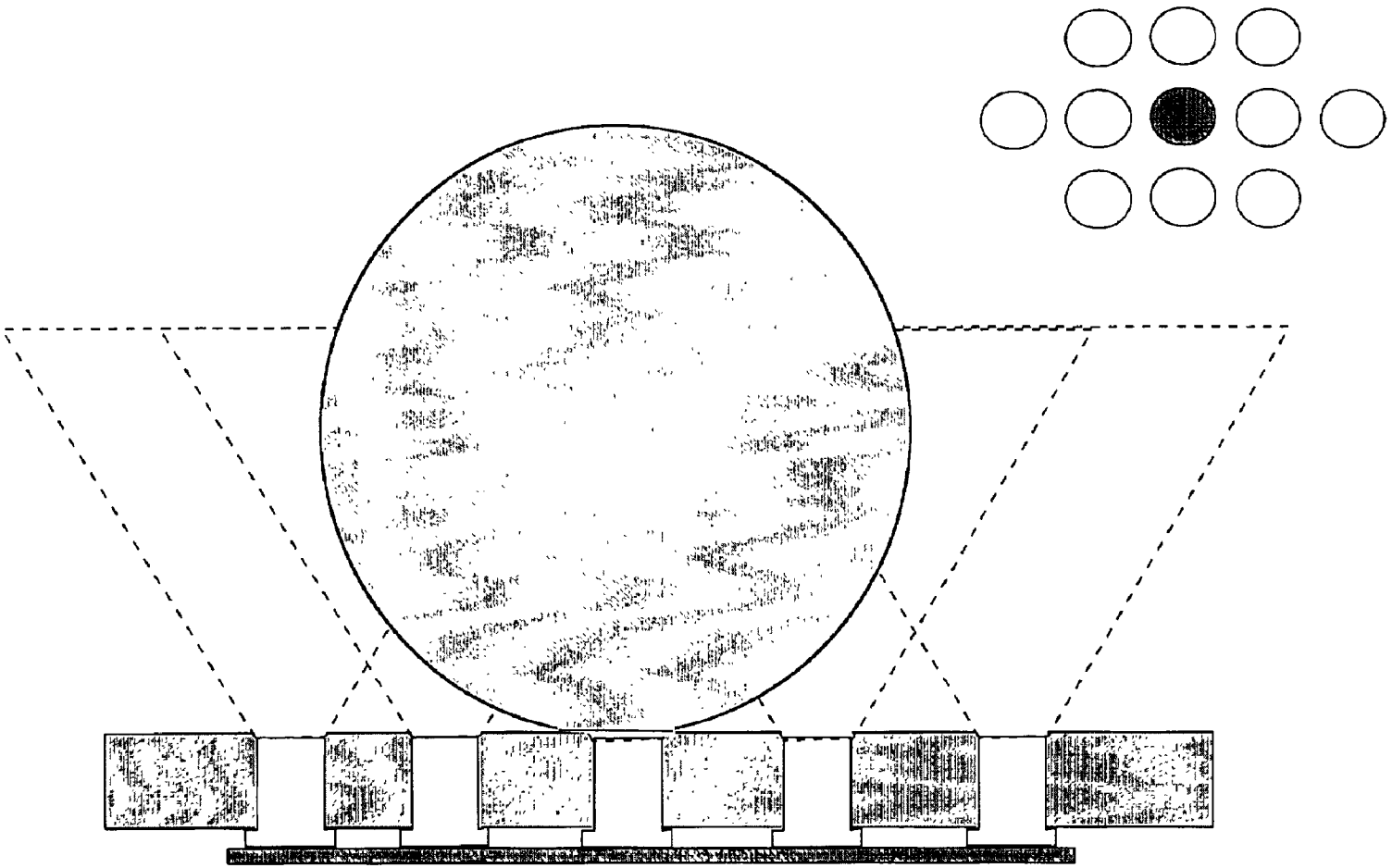
Figure 11C:
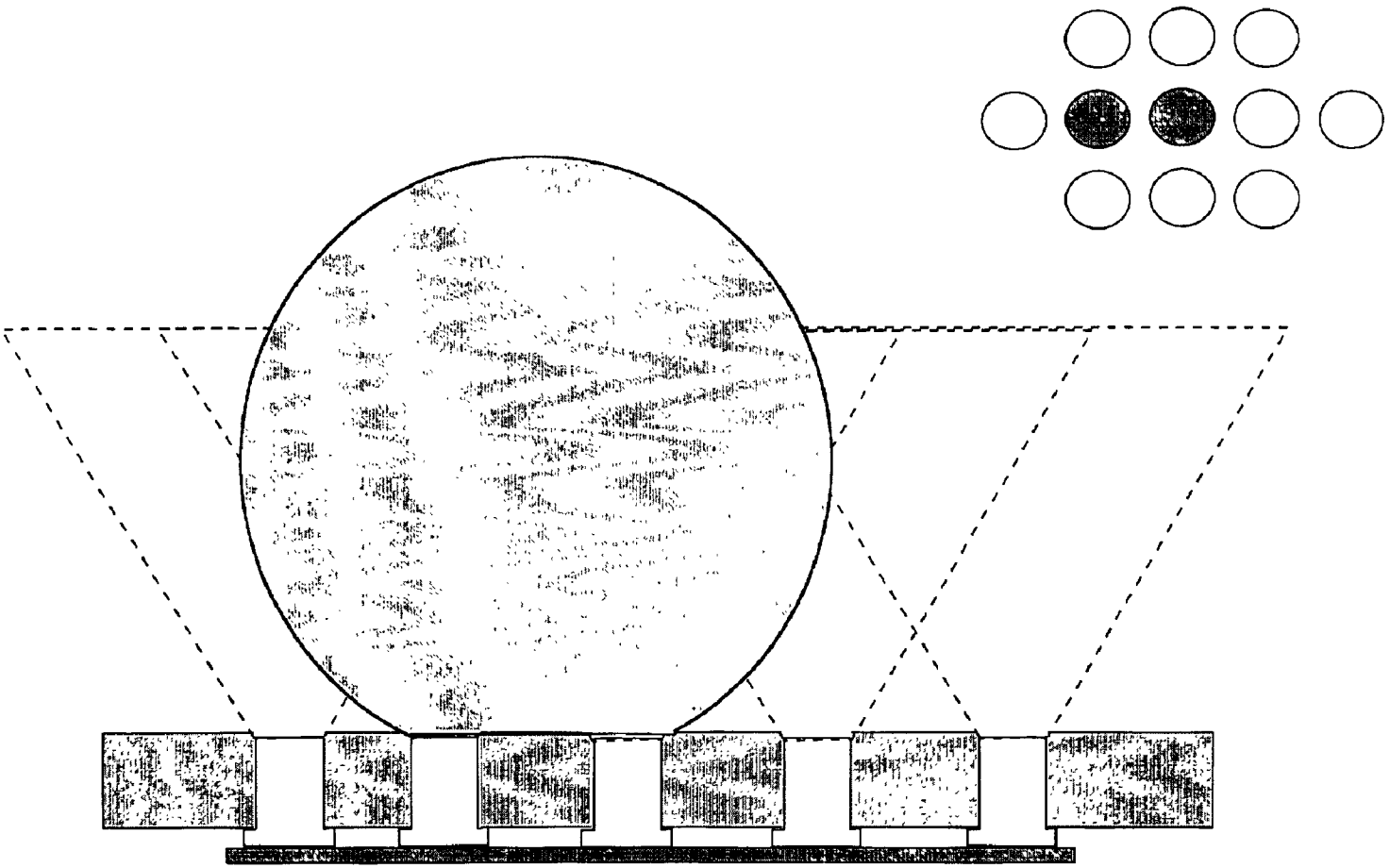
Figure 11D:
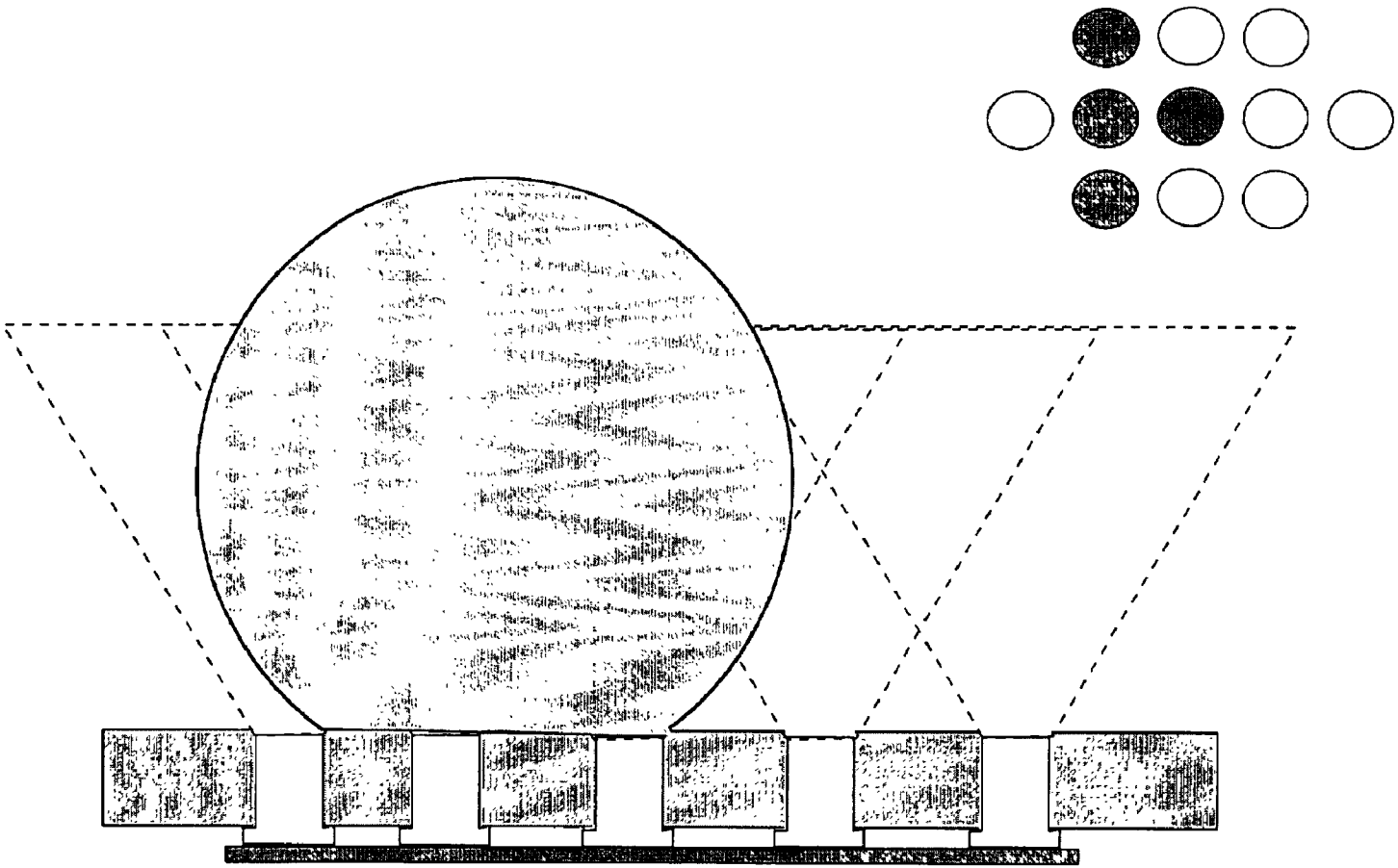
Figure 11E:
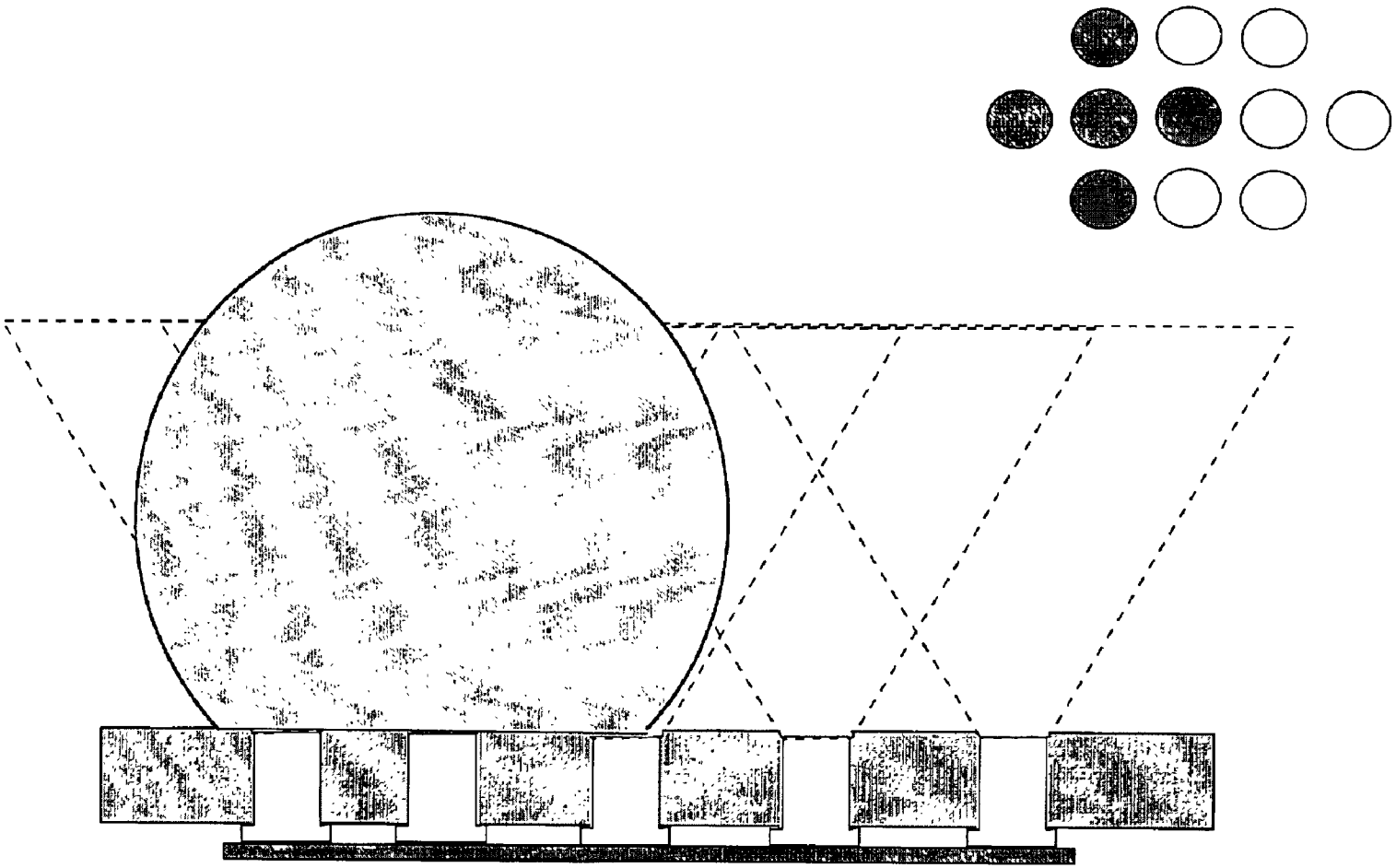
Figure 11F:
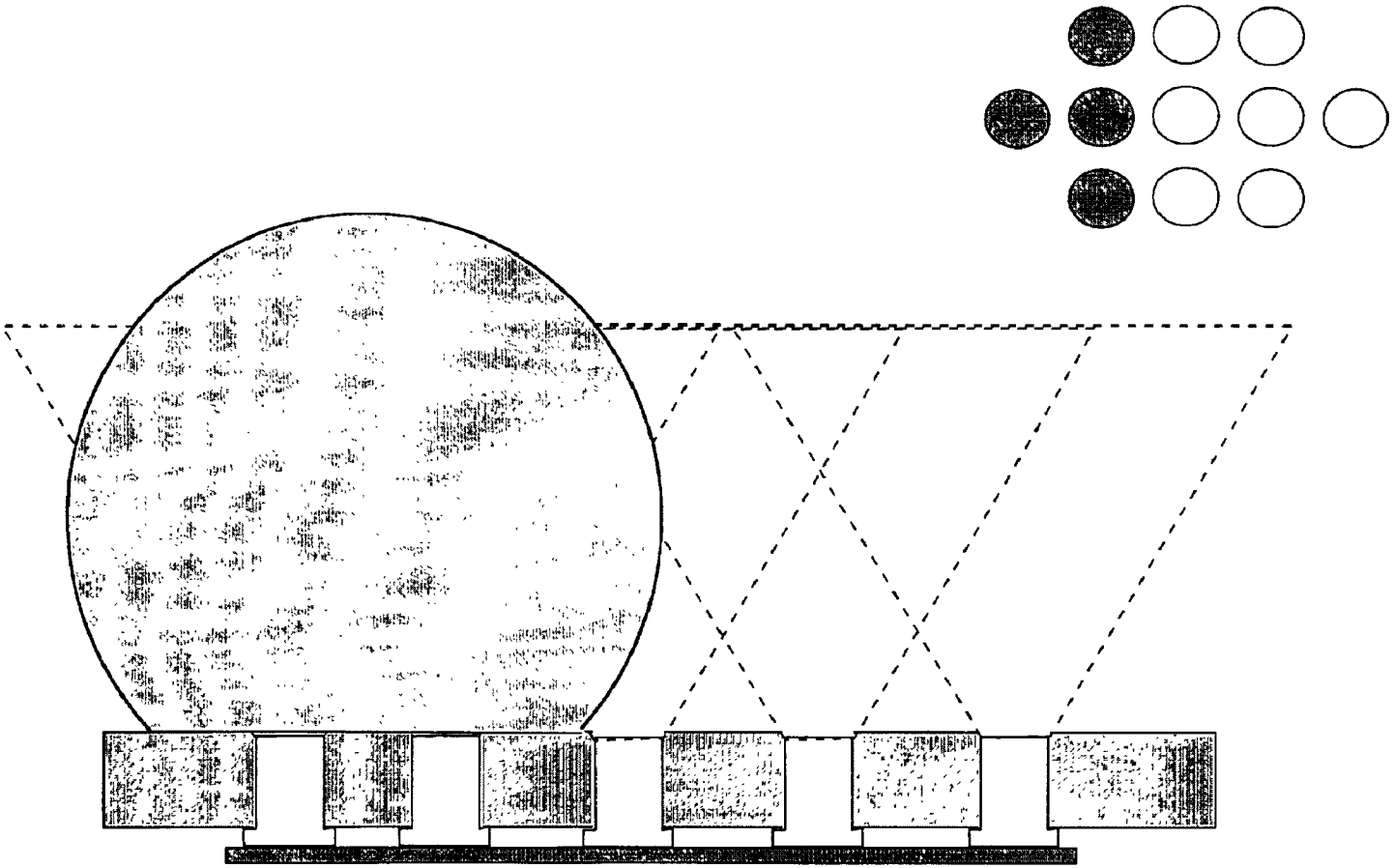
Figure 11G:
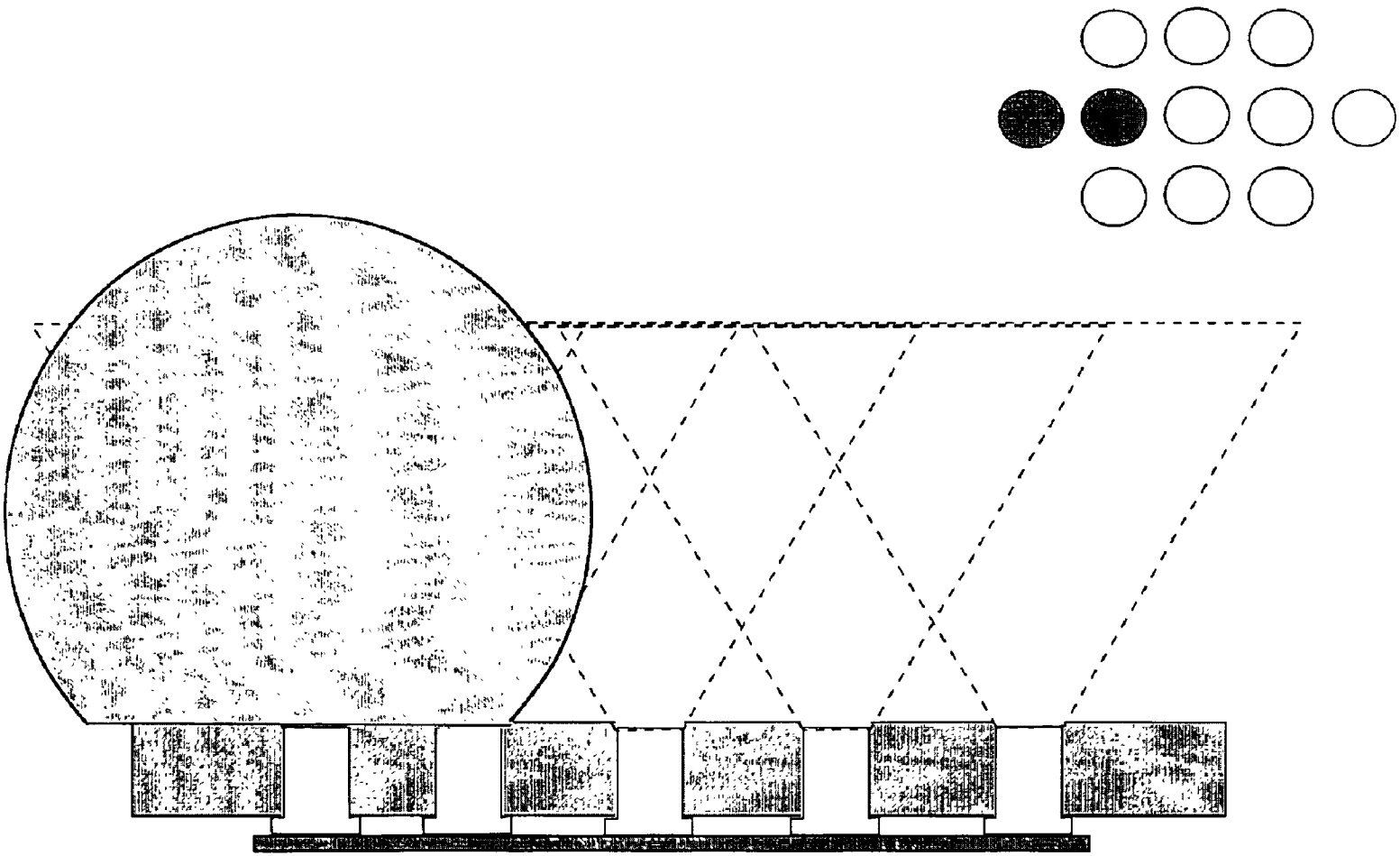
Figure 11H:
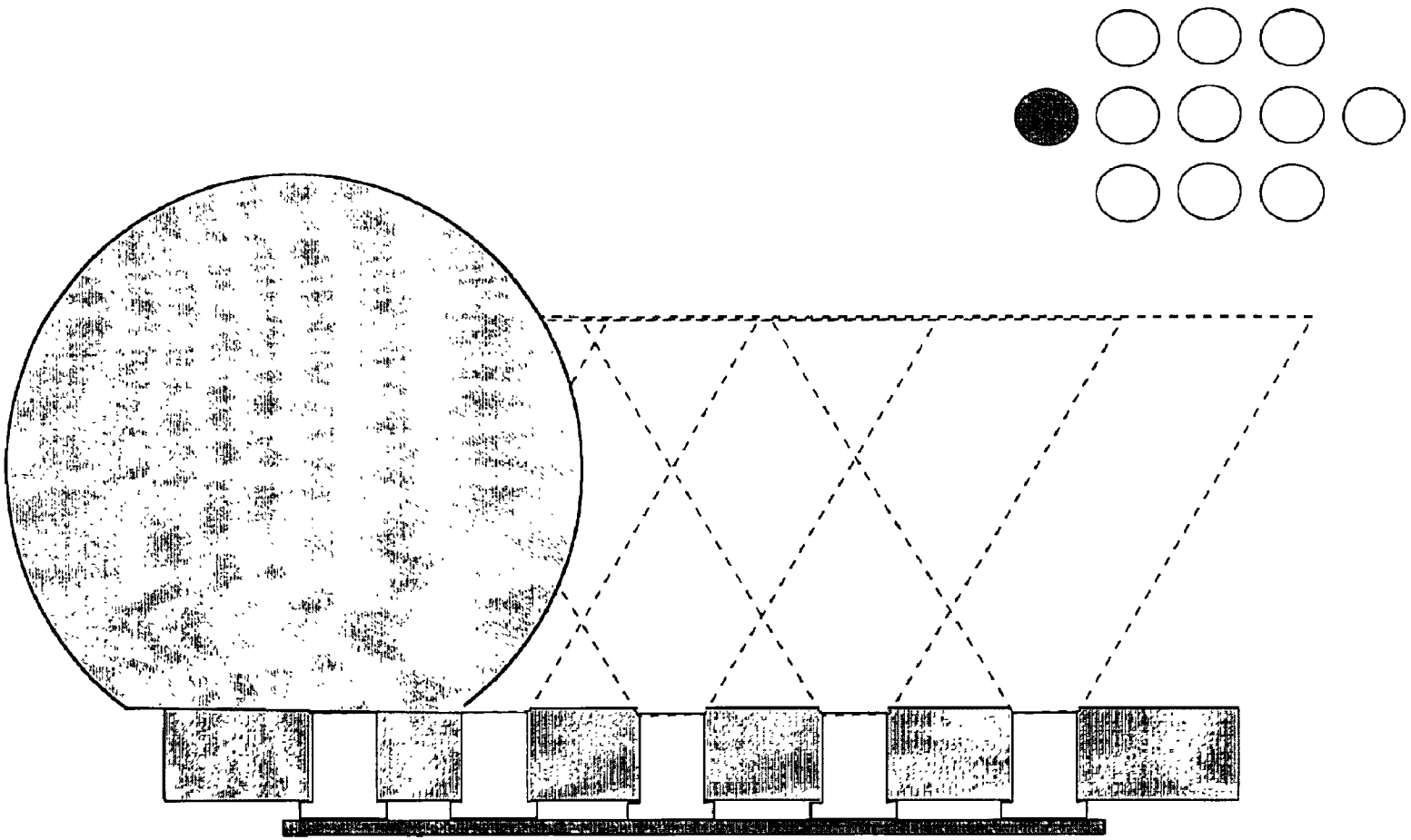
Figure 11I:
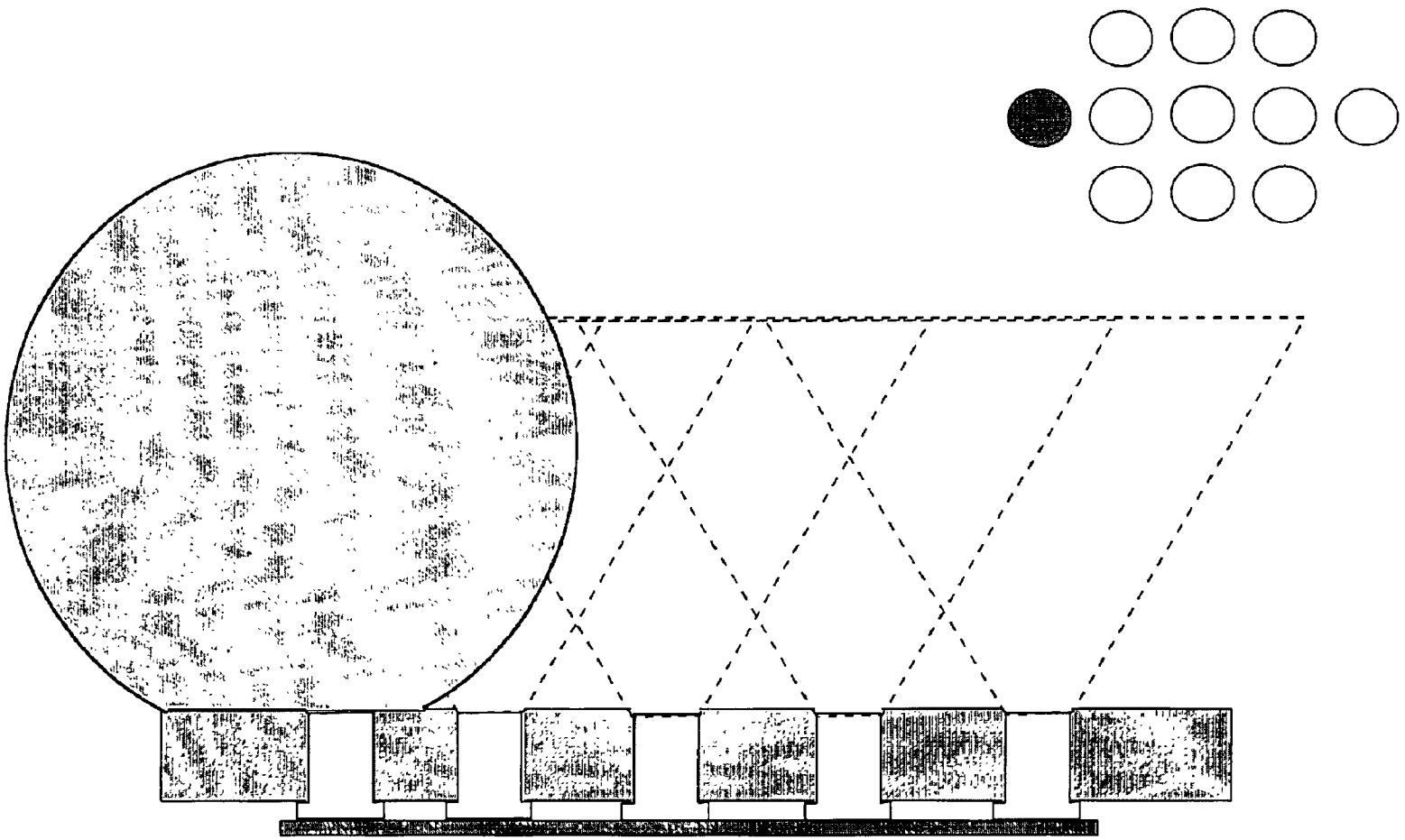
Figure 11J:
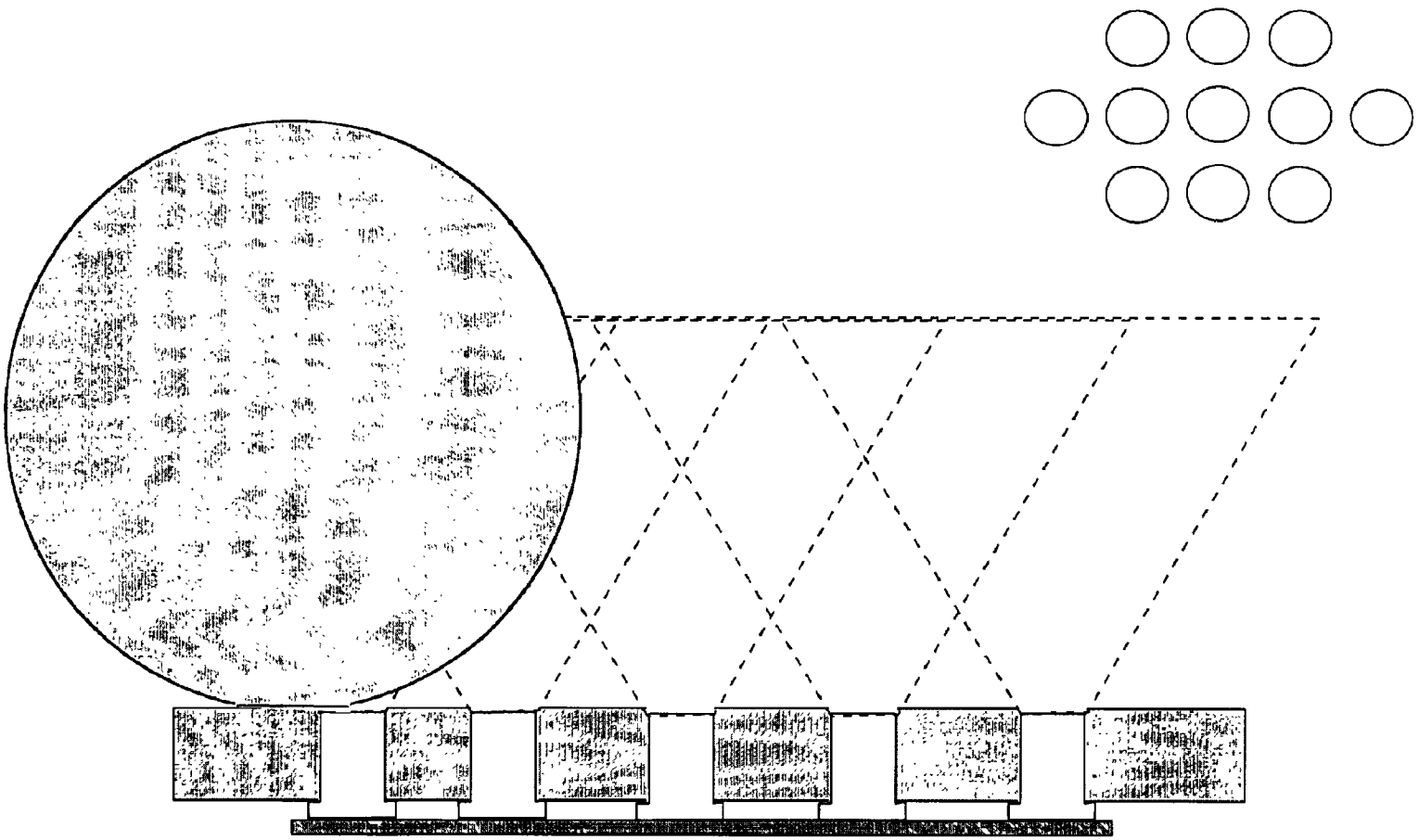
Figure 11K:
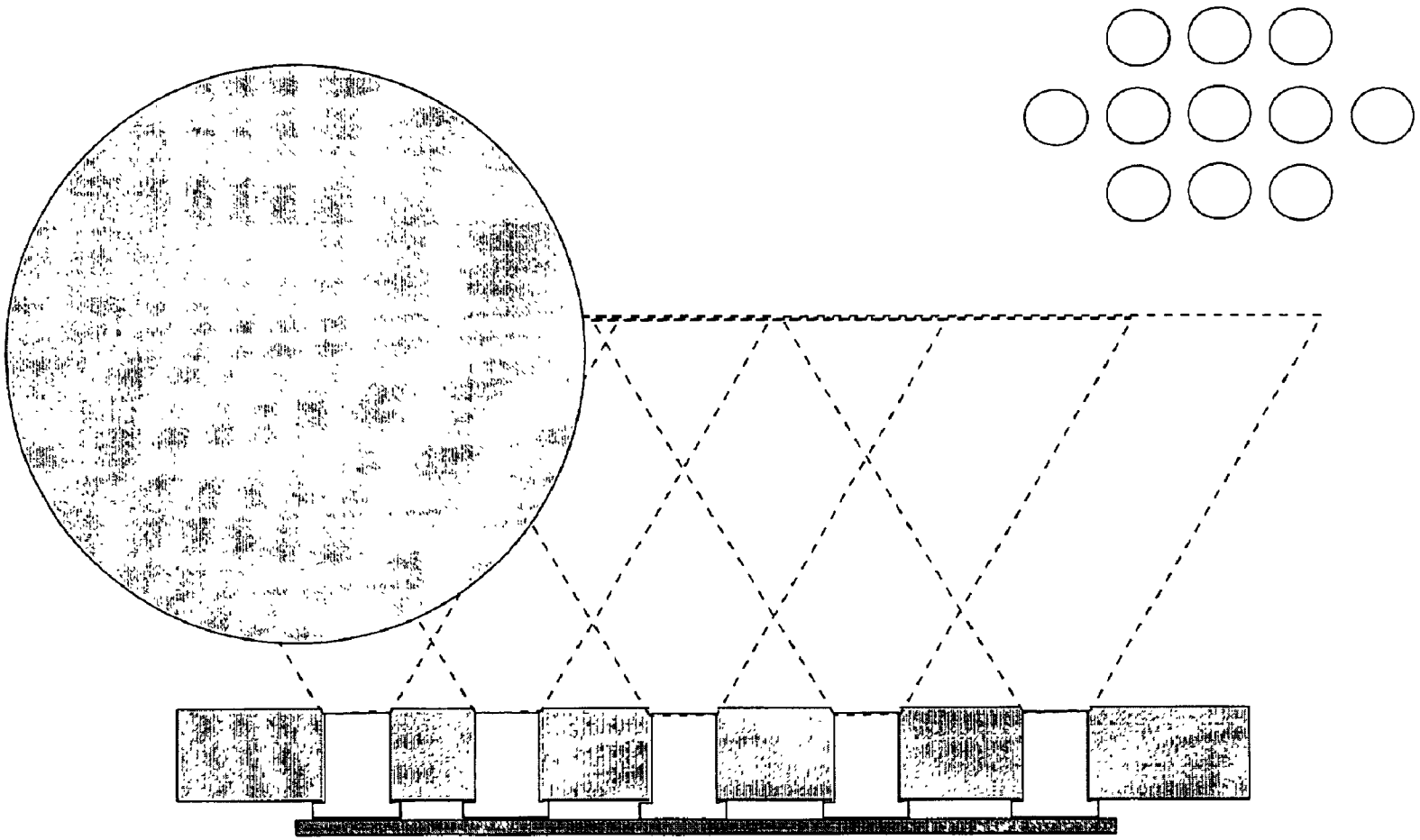

FIG. 10 is a schematic, sectional illustration of a grip end portion of the golf club of FIG. 1.

FIGS. 11*a* through 11*k* are schematic illustrations depicting the sequential contact of a ball with the club face of FIG. 1 and depicting the covering and uncovering of various sensors as the ball moves laterally across the club face during contact therewith.

DETAILED DESCRIPTION OF THE PREFERRED EMBODIMENT

Referring now in detail to the drawing figures, wherein like reference numerals represent like parts throughout the several views, FIG. 1 shows a golf club 100 according to a preferred form of the invention. As shown in FIG. 1, the electronic golf club 100 includes an end cap 45, a display array 44, a golf club shaft 42 with a grip 43, and a club-head 40. The club head 40 has mounted therein a sensor array 41. End cap assembly 45 connects to electronics 46 mounted within shaft 42. The electronics 46 within the shaft 42 processes signals from the sensor array 41 in the club head that are activated when the club head 40 impacts the golf ball 48. The sensor array 41 signals the electronics 46 to retrieve and process the impact information within a micro-controller memory system, and then display that information to the user using the display array 44 to allow the user to observe how and where golf ball 48 was hit relative to the sweet spot or center of the club face. If golf ball 48 does not cover any of the sensors in sensor array 41, and therefore does not signal complete blockage of the ambient light thereto, no indication of a hit will be presented to the user. When the golf ball 48 covers at least one sensor within the sensor array 41, the system is activated and will present the user with immediate feedback on where and how the ball impacted the club face. An additional feature is provided by electronics 46 by presenting a number of the most recent hit positions to be displayed on display array 44 at the push of a button, to allow the user to see the average cluster of where the ball is being hit. Thus, using this feedback information, the user can learn to hit the ball in a correct manner more consistently.

FIG. 2 shows the club head/sensor array configuration. The full assembly is mounted within the sweet spot area of club head 40 to position it such that the center sensors are aligned in the normal sweet-spot area of the club head. As shown, it is arranged as a matrix to provide 11 sensors (S1, S2, S3 . . . S11) spread evenly over the club face such that a golf ball which impacts in the very center of the club face will only cover the center sensor S6. Of course, additional sensors could be added if required to increase the resolution, or a different pattern could be employed if necessary. Sensor 24's are spaced such that the ball can normally cover only one sensor if it impacts the club face in that position. If the ball impacts the club face between two sensors, both are covered. Electronics 46 will detect that fact and can re-map the information into one position dot to be displayed. Thus, the 3/5/3 sensor matrix can be re-mapped to a higher resolution matrix for display. The matrix does not have to re-mapped in this matter, and could be much larger or smaller as appropriate. For clarity, the sensors within sensor array 41 (S1, S2, etc.) have been assigned numbers for discussion later.

Figure 3:
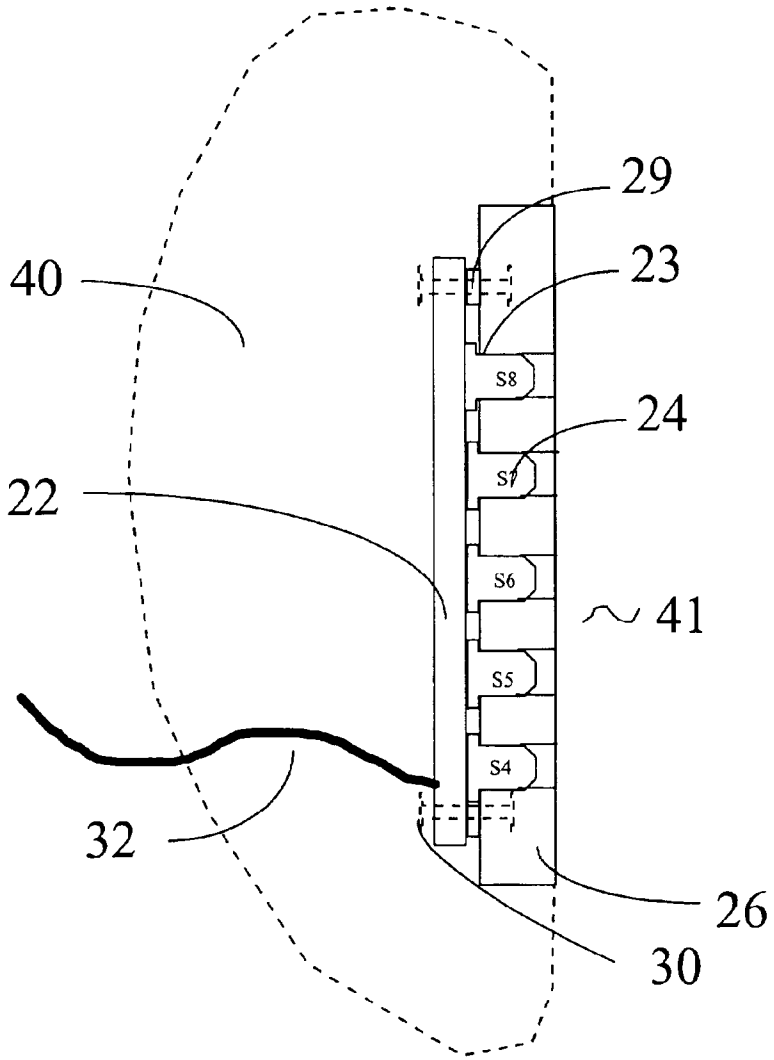
FIG. 3 is a schematic, section illustration of the club head portion of the golf club of FIG. 2.

FIG. 3 shows the sensor array system viewed from the top as mounted within club head 40. The entire sensor assembly 41 could be mounted by retainer 30 or other appropriate means to club head 40. Club face strike plate 26 is the front of the club face with multiple holes drilled, punched, or molded in it to create the positions of sensor array 41.

Sensor 24 is a photo-diode or photo-transistor, or other appropriate optical sensor, sensitive to the ambient light available while the club is in use. Retainer flange 23 is used to mount the sensors such as to create the desired mounting position of sensor 24 in club face strike plate 26. The energy in the golf ball 48 is absorbed by club face strike plate 26, thus protecting sensor 24 from damage. There are multiple sensors 24 arranged to produce a low resolution positional array on the club face strike plate 26. A larger number of sensors can be employed to produce a higher resolution positional array.

Cable 32 is a wiring harness, flex circuit, or other appropriate means of electrically connecting sensor PCB 22 to the electronics 46 located within the shaft 42.

As shown in FIG. 4, when the golf ball 48 impacts the club face, it compresses, covering one or more additional sensors 24, resulting in a absence of light detected by the appropriate sensors 24 within the sensor array 41. This action results in an electrical output signal relayed via cable or flex circuit 32 to the electronics 46 for processing. After processing, the recorded information is transferred to the display array 44 for observation by the user of the club, and also stored in internal memory for the display of the last several (preferably 8) positions, or "average" positions when requested by the user.

FIG. 4 also shows (in one dimension only for clarity) the configuration of a proper hit on the face of the sensor array 41. Golf ball 48 covers the center sensor 24, resulting in an absence of light detected by sensor S6. This information allows electronics 46 to read the position of where golf ball 48 impacted strike plate 26 and then process and display that information to the user via display array 44. This example would show the ball being hit at the center of the sweet spot of the club face.

FIG. 5 shows a side hit by the user. The ball impact description is as described above, but in this situation, sensor S5 is covered, resulting in a display indication to the user of a side hit.

Electronic Block Diagram

FIG. 6 shows the block diagram of the electronic system. Battery 61 provides the power for the entire system when in use by the user. It may be a rechargeable or non-rechargeable type battery that is small yet powerful enough to provide all power needed. Power button 7 activates solid state switch 2 when depressed by the user before use. The power is automatically deactivated if a ball does not cover a sensor in sensor array 41 for 1 minute or other appropriate time. All active electronic components reside on the main PCB board, electronics 46.

Power conservation is of paramount importance and is managed by the electronic subsystem. Micro-controller 9 is a very low power device, running at a speed low enough to conserve power, yet still provide the processing required. Hit detector 8 is designed to be powered during the entire session, but draws very little power and is activated if any one of the sensors in sensor array 41 sensing the absence of light.

The display array 44 is only activated during a hit/display cycle. Micro-controller 9 is a small microprocessor that controls all the functionality required by the system. Sensor interface 10 provides an interface for micro-controller 9 to read the sensor array 41. Display controller 4 is responsible for displaying information from micro-controller 9 on display array 44.

Display driver 5 provides the power drive capability to display the appropriate hit locations using the display cycle. Display array 44 could be a standard 5×7 dot matrix LED array, a custom LCD (Liquid Crystal Display)or other appropriate display technology applicable to this application. The entire electronics 46 could be packaged in an ASIC (Application Specific Integrated Circuit) or other modern technology to reduce size and cost.

Electronics Operation

The user actives power button 7 to provide power to the system at the beginning of the training or practice session. When the user hits a golf ball, hit detector 8 senses any one or more of the sensors in sensor array 41 being covered and signals micro-controller 9 that golf ball 48 is present on sensor array 41. Micro-controller 9 records the sensor information of sensor array 41 via sensor interface 10. As shown in FIG. 7, the positions of the ball over the sensors are recorded and stored within micro-controller 9 memory in time sync, that is, they are sampled and recorded at a known constant sample rate. In the example presented in FIG. 7, at time=0 (Any sensor covered) golf ball 48 has impacted on the center of strike plate 26 (club face) and covered the center sensor, S6. At time=0.0006, golf ball 48 has moved across strike plate 26 such that only sensor S5 is covered and recorded. On the next sample, at time=0.0012, sensors S4 and S5 are both covered as the golf ball 48 continues it's trail across strike plate 26. At time=0.0018, just before golf ball 48 leaves strike plate 26, sensor S4 is covered and recorded. When the record cycle is completed, the display portion of the cycle begins. Micro-controller 9 processes the sensor positional and time information recorded to create the display information for presentation by display array 44. This is displayed via display controller 4, display driver 5, and display array 44 to show the user the position the golf ball 48 impacted strike plate 26, and also the time displaced information of how the ball behaved while in contact with strike plate 26.

Again in FIG. 7, the example shows how the display is presented to the user. The first recorded position is shown in the very center at time=3.0 seconds from golf ball 48 impact. At time=3.2 seconds, the second display sequence shows the ball is rolling off of the club face to the left. Subsequent displays result in the user observing that the ball actually impacted the center of the club first, but rolled off to the left. Each display cycle last for an appropriate time to allow the user to observe the results, and is then repeated to make sure the user sees the information recorded. When completed, micro-controller 9 re-enables hit detector 8 to monitor sensor array 41 for another hit to occur. The recorded position of the initial hit position is then stored into the "average hit" memory to be used when desired by the user to display the last 8 positions in sequential order to produce an average hit position display.

There is considerable feedback information within each hit of the ball, but even more information can be derived from the average position of the last 8 hits. FIG. 8 shows the average initial hit display capability of the design. The initial position of each of the last 8 hits is recorded and stored in micro-controller 9 memory, one at a time. If the user presses average button 6, a request is sent to the electronics to display the last eight hit positions in proper order. Each position is individually displayed for a short period of time resulting in a sequential blinking of the positions recorded in a last in first out order. As shown, hit 1 would represent the oldest recorded data, while hit 8 would be the most recent. Thus, as long as the user holds the button down, the sequence is repeated to produce the average display. If all hits are on the same position, then only one display would blink 8 times, showing that the cluster is very tight and controlled. Therefore, the object would be for the user to adjust stance, swing, etc. until all the hits occurred on the center of the club, with only the center display being illuminated for 8 times per cycle, with the ball not rolling off the club face to the left or right (no hook or slice). Each new hit will record the latest position, and drop off the oldest position out of the 8 position memory, resulting in a running average of the last 8 positions displayed.

Controller Flow Chart

FIG. 9 shows the system software flowchart for all required functions including power management, hit processing, and display processing. Start block 50 is entered when the user activates power button 7 shown in FIG. 6. Hit monitor circuit 8 looks to see if any sensor in the PCB 22 is covered, resulting in absence of light. If connection is not detected in hit block 51, it loops back to start block 50 to look again. If a hit is detected in hit block 51, micro-controller 9 reconfigures the I/O ports in block 52 and resets the automatic power off "No Hit" timer. Then, read all sensors block 53 begins to read all sensors and store the data in time sync via store data block 54. None covered or time-out block 55 then checks to see if there are still sensors covered. If sensors are still covered, it loops to read all sensors block 53 and continues to read sensors in time sync. If no sensors are covered, the software senses the golf ball has left the club face and formats the data and expands time in block 56, and builds the display sequence information in block 57. Then, the display of the information to the user is controlled by block 57 until the display time is up in block 58. The hit information will be repeated more than once to give the user sufficient time to observe the information. When the display time is expired, block 58 transfers to reset hardware block 59 which resets the system registers. Thus, control is passed back to start block 50 for another sequence of hit and display until the user is finished with the use of the club and the automatic power shut down feature is activated.

While the software is scanning looking for a hit in hit block 51, it also looks for average button 6 to be pressed by the user. If the button is pressed, control is sent to display average hits block 64 and displays the average hit positions for one cycle. After displaying the average hit positions one cycle, control is passed back to block 50 for another look. Thus, if the user holds down average button 6, the average display will be continuously looping displaying the average hit positions until the button is released.

Electronics Compartment Description

FIG. 10 shows the handle mounted battery/electronics assembly. Battery 61 is contained within grip cap 65 at the top of grip 43 to provide a holder for the battery that will not be pertibated by operation of the club. Battery slot 74 allows the user to insert or remove the battery as required to change it out occasionally for a fresh battery. End cap 60 houses display array 44, power button 7, and average button 6. Electronic PC Board 46 is connected to grip cap 65 and is contained within shaft 42 for protection. Cable or flex circuit 32 connects electronics 46 PCB or flex circuit 22 located within the club head behind strike plate 26.

FIGS. 11*a* through 11*k* are schematic illustrations depicting the sequential contact of a ball with the club face of FIG. 1 and depicting the covering and uncovering of various sensors as the ball moves laterally across the club face during contact therewith. As shown the ball is likely to curve (hook or slice) during its flight as a result of the sliding contact with the club face during impact. This can be represented on the display to provide feedback to the user.

Also, the extent to which the ball compresses (how many additional sensors become covered) and how long the sensors are covered can be used to estimate the distance the shot would travel. This information can be displayed to the user, if desired.

Although shown in a driver configuration, those skilled in the art will quickly recognize that the invention can also be provided on iron or other type clubs as well.

The invention provides a learning tool to give immediate feedback for golfers to improve the accuracy with which they hit a golf ball with a golf club.

Advantageously, the electronic golf club according to the present invention provides immediate feedback of where the golf ball was hit in relation to the proper position, or sweet spot, on the head of the club.

Advantageously, the electronic golf club according to the present invention further provides positive feedback of how the ball was hit in relation to the proper angle, slice or hook by displaying time dependent information of how the ball behaved while in contact with the club face.

Moreover, the electronic golf club according to the present invention further provides a ready means to store the last few hit positions and display them upon command of the user to display the "average" dot spread of where the golf ball has been impacting the head.

Advantageously, the electronic golf club according to the present invention also provides the ability to record golf ball positional information in a very short time while the ball is in contact and compressed on the club face and display that information in a time expanded format for easy interpretation by the user.

The invention provide an alternative for practicing hitting a golf ball that produces useful feedback on how well the ball is hit, thus avoiding bad habit generation during practice.

The invention as described in this detailed description manages the power of the battery to maximize the actual use time of the electronic club in a training or practice session.

The electronic golf club system described herein can be adapted to irons, putters, as well as metal woods type clubs.

While the invention has been disclosed in preferred forms, it will be apparent to those skilled in the art that many modifications, additions, and deletions can be made therein without departing from the spirit and scope of the invention as set forth in the following claims.

Component Definition

40 Golf Club Head—Conventional Golf Club Head.

41 Optical Sensor Array—an array of sensors formed by mounting optical sensors in a prearranged hole pattern on the face of a golf club.

42 Shaft—Conventional golf club shaft.

43 Grip—Conventional golf club grip.

44 Display Array—Display array of Light Emitting Diodes or Liquid Crystal Display to present graphical information to the user.

46 Electronics—Electronics to process information and display it to the user.

49 Club head/Sensor Assembly—the entire electronics golf club with electronics.

24 Sensor—An optical sensor that senses the absence of light when covered by a compressed golf ball.

22 PCB or Flex Circuit—a means for connection the optical sensors to the cable or flex circuit.

23 Retainer Flange—Part of a Sensor 24 that allows the pin to captive in a hole in the face of the club.

26 Strike Plate—The Club face with holes to allow the Sensors to look for the ball in contact with the club face. The strike plate absorbs the energy of the ball.

29 Spacer—A spacer to position the elements of the sensors properly.

30 Retainer—retaining mechanism to hold Sensor PCB to the rear of the club face.

48 Golf Ball—A conventional golf ball.

60 End Cap—End cap housing the switches and display on the end of the club handle.

61 Battery—Conventional battery.

65 Grip Cap—Cap for holding the battery and display on the handle end of the club.

74 Battery Slot—Slot for inserting and removing the battery.

2 Solid State Switch—An electronic switch used to power to the electronics.

4 Display Contoller—Appropriate electronics to control a display for viewing by the user.

5 Display Driver—Appropriate electronics to operate a display for viewing by the user.

6 Average Button—Button to request to view the average hit position.

7 Power Button—Power on switch.

8 Hit Detector—Appropriate electronics senses the absence of light from any sensor and start the recording sequence.

9 Micro-controller—a low power micro-controller to process and control all aspects of the club's operation.

10 Sensor interface—Appropriate electronics to interface to the sensor array and present sensors which are covered information to the micro-controller.

What is claimed is:

1. A golf training club for use by a golfer, comprising:

a shaft having a grip end and a tip distal from the grip end;

a club head affixed to the shaft proximate the tip of the shaft and having a face plate for striking a golf ball, wherein the face plate defines a plurality of holes extending therethrough, and wherein each hole is adapted to allow ambient light to enter from outside the club head and to pass into the hole;

a plurality of optical sensors for detecting contact between the face plate and the golf ball, wherein each optical sensor is positioned within the club head absent contact with the face plate and extends at least partially into a uniquely associated hole of the plurality of holes, wherein each optical sensor is operable to detect the substantial absence of ambient light passing into the hole uniquely associated therewith that may occur when the golf ball and face plate are in contact during a hit of the golf ball with the club head, and wherein each optical sensor is adapted to produce an electrical signal in response to detecting a substantial absence of ambient light;

electronics mounted within the shaft for receiving at least one electrical signal from the optical sensors during a hit of the golf ball and for processing the at least one received electrical signal to determine the location of contact between the face plate and the golf ball; and a display for displaying at least the location of contact between the face plate and the golf ball.

2. A golf training club as claimed in claim 1 wherein the plurality of optical sensors comprises an array of optical sensors arranged so that at least one optical sensor detects a substantial absence of ambient light during a hit of the golf ball with the club head.

3. A golf training club as claimed in claim 1 wherein the display is mounted proximate the grip end of the shaft.

4. A golf training club as claimed in claim 1 wherein the electronics are further operable to process electrical signals produced by different optical sensors at different times during a hit of the golf ball to detect the existence and extent of side spin resulting from lateral movement of the golf ball while in contact with the face plate during the hit of the golf ball.

5. A golf training club as claimed in claim 1 wherein the electronics are further operable for processing a received electrical signal from an optical sensor to determine whether the substantial absence of ambient light detected by the optical sensor corresponds to the initial impact of the golf ball against the face plate during the hit of the golf ball and to determine whether to storing data representative of electrical signals subsequently received during the hit of the golf ball.

6. A golf training club as claimed in claim 1 wherein the electronics are further operable to store data representative of electrical signals received from optical sensors corresponding to the locations of initial contact of the face plate and a golf ball from more than one hit and to subsequently cause the display of images showing such locations in sequence according to the order in time of the corresponding hits.

7. A golf training club as claimed in claim 6 wherein the electronics are are further operable to cause the display of an image of an average hit taken over a previous collection of hits.

8. A golf training club as claimed in claim 7 wherein the electronics are further operable to cause the display of a composite image of numerous prior hits to show a pattern of the locations of initial contact.

9. A golf training club as claimed in claim 1 wherein the electronics are further operable to calculate an estimated distance the golf ball would travel based at least in part on measurements made at the face plate at impact with the golf ball.

10. A golf training club for use by a golfer, comprising:

a shaft having a grip end and a tip distal from the grip end;

a club head affixed to the shaft proximate the tip of the shaft and having a face plate for striking a golf ball, wherein the face plate defines a plurality of holes arranged in a pattern and extending therethrough, and wherein each hole is adapted to allow ambient light to enter from outside the club head and to pass into the hole;

a plurality of optical sensors embedded within the club head and separated from the face plate for detecting contact between the face plate and the golf ball, wherein each optical sensor is positioned to receive ambient light passing into a corresponding hole that is optically coupled therewith, and wherein each optical sensor is operable to produce an electrical signal in response to the corresponding hole being substantially covered by the golf ball during a hit of the golf ball with the club head;

electronics for processing signals received from the plurality of optical sensors and for analyzing at least one characteristic of the contact between the face plate and the golf ball during a hit of the golf ball with the club head; and a display for displaying the at least one characteristic of the contact between the face plate and the golf ball, and wherein the display includes a plurality of individually illuminable elements visible at the grip end of the shaft and arranged in a pattern corresponding to that of the plurality of holes such that each of the individually illuminable elements uniquely corresponds in one-to-one correspondence with a particular hole of the face plate.

11. A golf training club as claimed in claim 10 wherein the display is mounted at the grip end of the shaft.

12. A golf training club as claimed in claim 10 wherein the at least one characteristic comprises the location of the contact on the face plate, and wherein the electronics are further operable, in response to the contact, to illuminate the individually illuminable element corresponding to the hole nearest the location of the contact.

13. A golf training club as claimed in claim 12 wherein the at least one characteristic further comprises the existence and extent of side spin resulting from lateral movement of the golf ball while in contact with the face plate during the hit of the golf ball, and wherein the electronics are further operable to sequentially illuminate individually illuminable elements corresponding to the direction of the lateral movement of the golf ball.

14. A golf training club as claimed in claim 12 wherein the at least one characteristic further comprises the extent of golf ball compression resulting from golf ball contact on the face plate.

15. A golf training club as claimed in claim 10 wherein the electronics are further operable to collect and store data representative of electrical signals produced by optical sensors during the hit of the golf ball, and the electronics are further operable to detect the initiation of the hit and to begin collecting and storing the data in response to such detection.

16. A golf training club as claimed in claim 10 wherein the electronics are further operable to collect and store data representative of electrical signals produced by optical sensors from more than one hit and to cause the display of an image representing the data by selectively illuminating individual illuminable elements of the display.

17. A golf training club as claimed in claim 16 wherein the electronics are operable to cause the display of an image of an average hit determined from a collection of hits.

18. A golf training club as claimed in claim 16 wherein the electronics are further operable to cause the display of a composite image of numerous prior hits to show the pattern of contact location.

19. A golf training club as claimed in claim 10 wherein the electronics are further operable to calculate an estimated distance the golf ball would travel based at least in part on measurements made at the face plate at impact with the golf ball.

* * * * *